US009494366B1

(12) United States Patent
Thut

(10) Patent No.: US 9,494,366 B1
(45) Date of Patent: Nov. 15, 2016

(54) SYSTEM AND METHOD FOR PUMPING MOLTEN METAL AND MELTING METAL SCRAP

(71) Applicant: Bruno Thut, Chagrin Falls, OH (US)

(72) Inventor: Bruno Thut, Chagrin Falls, OH (US)

( * ) Notice: Subject to any disclaimer, the term of this patent is extended or adjusted under 35 U.S.C. 154(b) by 0 days.

(21) Appl. No.: 14/749,864

(22) Filed: Jun. 25, 2015

(51) Int. Cl.

| | |
|---|---|
| ***F27D 3/14*** | (2006.01) |
| ***B22D 41/00*** | (2006.01) |
| ***F27D 3/00*** | (2006.01) |
| ***C22B 9/16*** | (2006.01) |

(52) U.S. Cl.
CPC . *F27D 3/14* (2013.01); *C22B 9/16* (2013.01); *F27D 3/0024* (2013.01); *F27D 3/0025* (2013.01); *F27D 2003/0054* (2013.01)

(58) Field of Classification Search
CPC ..... F04D 29/086
USPC ..... 222/590, 594
See application file for complete search history.

(56) References Cited

U.S. PATENT DOCUMENTS

| | | | | |
|---|---|---|---|---|
| 6,217,823 | B1 | 4/2001 | Vild et al. | |
| 6,881,030 | B2 | 4/2005 | Thut | |
| 7,497,988 | B2 | 3/2009 | Thut | |
| 7,507,365 | B2 | 3/2009 | Thut | |
| 7,687,017 | B2 | 3/2010 | Thut | |
| 8,246,715 | B2 * | 8/2012 | Thut | C22B 21/0092 75/375 |
| 9,057,376 | B2 * | 6/2015 | Thut | F04D 29/086 |
| 9,057,377 | B1 | 6/2015 | Thut | |
| 2013/0292427 | A1 * | 11/2013 | Cooper | B22D 37/00 222/594 |

OTHER PUBLICATIONS

"Bimba Pneumatic Control Systems Model PCS"; Bimba Product Brochure; pp. 7.25-7.30.
"Bimba Position Feedback Cylinders"; Bimba Product Brochure; pp. 7.5-7.6.
Electrack 205 Brochure by Thomson; pp. D-26, D-27, D-53, D-54 & D-57.
Schneider; "Working With Positions-Feedback Cylinder Technology"; Reprinted from Hydraulics & Pneumatics; Sep. 1996.

* cited by examiner

*Primary Examiner* — Scott Kastler
(74) *Attorney, Agent, or Firm* — Abel Law Group, LLP

(57) ABSTRACT

A system for pumping molten metal and melting metal scrap in a furnace that includes a first well that is separated from a second well by a refractory separating wall. The first well and the second well are in fluid communication with a main vessel, the separating wall including a passageway for molten metal. The system includes a pump disposed in the first well for pumping molten metal. A scrap charging vessel is disposed in the second well into which the scrap is added to molten metal contained therein. A conduit extends from the pump over the separating wall. Molten metal pumped from the pump travels from the conduit into the scrap charging vessel.

17 Claims, 7 Drawing Sheets

SYSTEM AND METHOD FOR PUMPING MOLTEN METAL AND MELTING METAL SCRAP

FIELD OF THE INVENTION

The present disclosure relates to pumps for pumping molten metal, in particular, to systems used for melting metal scrap.

BACKGROUND OF THE INVENTION

Pumps for pumping molten metal are used in furnaces in the production of metal articles. Common functions of pumps are circulation of molten metal in the furnace or transfer of molten metal to a remote location along risers that extend from a base of the pump connected to conduit that extends to the remote location. The transfer function of the pump avoids a tapping operation which is dangerous and problematic. The pump may be located in a separate, smaller chamber such as a pump well adjacent the main hearth.

Currently, many metal die casting facilities employ a hearth containing a large proportion of the molten metal volume of the furnace. Solid ingots of metal may be periodically melted in the hearth. Metal scrap such as from aluminum cans is often charged into the molten metal in a scrap well adjacent the hearth. A transfer pump may be located in a separate well adjacent the hearth. The transfer pump draws molten metal from the well in which it resides and transfers it into a ladle, for example, from which the molten metal is taken to a holding furnace and fed into a plurality of die casters that form metal articles. Die casting furnaces often employ only a transfer pump, not a circulation pump. When scrap metal is added, it lowers the temperature of the molten metal. Burners located above the molten metal in the hearth must maintain molten metal temperature while compensating for the drop in temperature caused by scrap charging. A tremendous amount of fuel is required by the burners to heat and maintain the molten metal at a suitable temperature. In view of the heat applied by the burners at the surface of the molten metal and the cold scrap added to the bath, temperature differences arise in the bath.

Significant considerations in a die casting facility include the consumption of fuel and cleanliness and physical properties of the cast metal articles. Aluminum oxide is formed on the surface of the molten metal as the molten aluminum oxidizes. Aluminum oxide has an affinity for hydrogen gas. It is undesirable to have hydrogen gas in the metal. As the cast metal solidifies it releases trapped hydrogen gas, forming pin holes in the metal articles. Higher temperatures of molten aluminum lead to increased absorption of hydrogen gas and increased pin hole defects with resulting compromise in the physical properties of the metal articles.

An apparatus made by High Temperature Systems Inc. moves molten metal using a pump into a CORIOLIS® scrap charging vessel as described in U.S. Pat. No. 7,497,988 ("CORIOLIS® vessel patent"), which is incorporate herein by reference in its entirety. The pump can include a riser and a conduit that extends through a separating wall between a pump well and a charging well. Or, there may be no wall between the pump and scrap charging vessel. The molten metal that passes through the scrap charging, vortexer vessel leaves it through a lower passage in the vessel, thereby entering the well. The metal can be pumped through a lower archway of the separating wall between wells and through the higher opening in the separating wall into the scrap charging vessel. Another approach is to physically remove the refractory separating wall between wells. Metal processing companies have expressed a reluctance in removing the separating wall because it is very labor intensive and costly to do so.

A suitable pump made by High Temperature Systems, Inc. for use with the CORIOLIS® scrap charging vessel is a CHAMELEON® multifunctional pump as described in U.S. Pat. Nos. 7,687,017 and 7,507,365 ("the CHAMELEON® pump patents"), which are incorporated herein by reference in their entireties. The pump is designed to move an impeller into one, two or three stacked impeller chambers extending along the same vertical axis. This enables the pump to discharge the molten metal for circulating the molten metal of the furnace and to transfer the molten metal to one or more locations depending on which impeller chamber the impeller is positioned for rotation. For example, the molten metal can be sent through a conduit extending through the separating wall into the scrap charging vortexer vessel when it is desired to add scrap to the molten metal. On the other hand, during other periods when scrap is not charged, the molten metal can be circulated through the furnace, which reduces the effects of temperature gradients. This circulation can occur through a lower through-passageway in the scrap charging vessel.

DISCLOSURE OF THE INVENTION

A first aspect of the disclosure features a system for pumping molten metal and melting metal scrap in a furnace that includes a first well that is separated from a second well by a refractory separating wall. The first well and the second well are in fluid communication with a main vessel containing a volume of molten metal greater than a combined volume of molten metal in the wells (e.g., a hearth). The separating wall includes a lower passage for molten metal. A pump is disposed in the first well and pumps molten metal. A scrap charging vessel is disposed in the second well into which the scrap is added to molten metal contained therein. One example design of the scrap charging vessel includes an exterior surface, an interior surface forming a mouth at an upper end portion that can receive the molten metal and an outlet. A conduit is in fluid communication with the pump and extends over (i.e., not through), the separating wall. Molten metal pumped from the pump travels from the conduit into the scrap charging vessel.

Referring to more specific features of the first aspect of the disclosure, the first well and the second well can be separated from the hearth by a refractory hearth wall and the outlet of the scrap charging vessel is in fluid communication with a passageway in the hearth wall to flow molten metal from the scrap charging vessel into the hearth. For example, this hearth wall passageway is in addition to an archway in the hearth wall that is in communication with the second well in which the scrap charging vessel resides. The scrap charging vessel can be disposed in close proximity to or in contact with the hearth wall. In one variation, the scrap charging vessel can be spaced from the hearth wall or not, and an optional second conduit can extend from the outlet of the scrap charging vessel to the passageway in the hearth wall in fluid communication with the hearth. For example, the scrap charging vessel is spaced from the hearth wall and the second conduit is fastened in contact with the scrap charging vessel and the hearth wall, and extends from and adjacent the outlet of the scrap charging vessel and from and adjacent the hearth wall passageway. Molten metal travels from the scrap charging vessel into the hearth, rather than from the scrap charging vessel into the second well, through its archway and then into the hearth. Of course, molten metal is still disposed in the second well as it flows through the archway between the first and second wells and through the archway into the hearth (e.g., a second well archway).

Another specific feature is that the pump can include a base including an impeller chamber, a base inlet opening in fluid communication with the impeller chamber and a base outlet opening from the impeller chamber. Also included is a refractory pump shaft. A motor is adapted to rotate the shaft. A refractory impeller is fastened to the shaft and adapted to be rotated in the impeller chamber. Further specific features are that there can be a refractory shaft sleeve between the motor and the base. The shaft sleeve can be pressurized and enclosed at an upper end portion, whereby inert gas can be fed down the shaft sleeve as in the case of the POSEIDON® pump made by High Temperature Systems Inc. The design of the shaft sleeve and POSEIDON® pump are suitable for use in the apparatus of the present disclosure and can be as described in allowed U.S. patent application Ser. No. 14/156,883 and U.S. Pat. No. 9,057,377 ("POSEIDON® pump patents"), which are incorporated herein by reference in their entireties. This will provide one, two or more openings in the shaft sleeve or a gap between the shaft sleeve and the base, which facilitates gas and molten metal flow. The base can include a volute portion or nonvolute portion in one or each impeller chamber.

In yet another specific feature, the pump can include a riser extending between the base outlet opening and the conduit. Another feature is that the outlet opening is referred to as a second outlet opening and the impeller chamber it extends from is referred to as a second impeller chamber, the riser extending from the second outlet opening and being connected to the conduit that extends over the separating wall for discharge into the scrap charging vessel. Still further, the first base outlet opening can be a passageway that leads to an exterior of the base so as to discharge the molten metal from the first well through the passage in the separating wall into the second well. This can be used to circulate the molten metal in the furnace.

Yet another specific feature is that the base can include a third impeller chamber. The base inlet opening is in fluid communication with at least one of the first impeller chamber, the second impeller chamber and the third impeller chamber. A third base outlet opening extends from the third impeller chamber. A second riser extends from the third outlet opening for transferring molten metal to a location outside of the first well. A conduit can be attached to the second riser. In all aspects of this disclosure a particular feature is that risers can be formed of graphite and conduit can be formed of steel, for example.

Still further, the interior surface of the scrap charging vessel can have a shape selected from the group consisting of frustoconical shaped, bowl shaped, cup shaped, and combinations thereof. An example of a bowl shape is a round, concave interior surface, and an example of a cup shape is a hollow cylinder. Yet another specific feature is that the interior surface of the scrap charging vessel can have a sloped side surface. The scrap charging vessel can include a bottom surface, and the outlet from the scrap charging vessel extends from the bottom surface. Another feature is that the riser from the second outlet opening extends to a height near a top of the separating wall. The conduit extends from this location over the separating wall so as to discharge into the scrap charging vessel.

A second aspect of the disclosure features a method of pumping molten metal and melting metal scrap using the aforementioned system and any of the specific features thereof alone or in combination. The method includes rotating the impeller so as to pump molten metal from the first well, through the conduit over the separating wall and into the scrap charging vessel. An optional vortex is created in the scrap charging vessel when the molten metal entering the scrap charging vessel flows along the interior surface of the vessel toward the outlet of the scrap charging vessel. Scrap is charged into the scrap charging vessel. The scrap is melted in the scrap charging vessel. In one specific feature the molten metal can be passed from the scrap charging vessel through the outlet thereof and directly into the hearth.

A more specific feature of the second aspect of the disclosure includes the aforementioned method steps, and further steps and a further specific system of using an impeller positioning device to move the impeller into the first impeller chamber, wherein the first outlet is an outlet or discharge passageway to an exterior of the base. The impeller is rotated in the first impeller chamber so as to pump molten metal from the first well, through the outlet passageway, through the lower opening in the separating wall and into the second well. This can be used for circulating the molten metal through the furnace.

Yet another specific feature of the second aspect of the disclosure includes all of the aforementioned method steps, and further steps and a further specific system of using the impeller positioning device to move the impeller into the third impeller chamber. The impeller is rotated in the third impeller chamber so as to pump molten metal from the first well through the second riser and transferring the molten metal to a location outside of the first well.

The impeller can maximize molten metal discharge into one base outlet passageway with which it is aligned and can minimize molten metal discharge into another base outlet passageway with which it is not aligned. In transfer mode, the shaft is moved vertically to position the impeller in the third transfer impeller chamber where it is rotated. This causes molten metal to be directed into a base inlet opening, into the third impeller chamber, through the discharge passageway, through a riser and through the outlet conduit to an intended location outside the first well. In circulation mode, the shaft is moved vertically to position the impeller in the first impeller chamber where it is rotated. This causes molten metal to be directed into the base inlet opening, into the first impeller chamber, through the discharge passageway, through the lower passageway in the separating wall and into the second well. In scrap charging mode, the shaft is moved vertically to position the impeller in the second transfer impeller chamber where it is rotated. This causes molten metal to be directed into the base inlet opening, into the second impeller chamber, into the first riser, through the conduit over the separating wall and into the scrap charging vessel. The inlet into the scrap charging vessel in any aspect of the disclosure may be through the side wall of the scrap charging vessel. This may be tangentially oriented relative to the interior surface in a top view. On the other hand it may be possible for molten metal to enter the scrap charging vessel by flowing from above through the mouth of the vessel, such as by orienting the conduit over the top of the mouth. In this design in which the conduit is above the scrap charging vessel, the first conduit might also be tangentially oriented relative to the interior surface in a top view.

Either the shaft and impeller alone, or the motor itself, can be moved vertically by a manual, hydraulic, pneumatic, screw-type or other actuator device using the CHAME- LEON® multifunctional pump by High Temperature Systems Inc. and as disclosed in the CHAMELEON® pump patents. The pump has the ability to move the impeller in one, two, three or several desired positions or it may facilitate what is referred to herein as "infinite adjustment" wherein a programmable logic controller ("PLC") sends signals to the actuator instructing movement of the impeller to one of a plurality of position increments. A component of the impeller positioning device (e.g., a PLC) may also receive feedback signals informing it of the position of a component of the actuator, and thus the impeller or shaft position, at any point in time. The PLC can be programmed to put the pump into a desired mode at a particular time or event, for example, to be placed in scrap charging mode at a certain time or elapsed time, or when the temperature of the bath reaches a certain level. This mode can be programmed to last for a particular duration. The same is true for circulation mode. The PLC can be programmed to place the pump into circulation mode at all other times or certain times and for certain durations throughout the day. The transfer mode may also be programmed such as to last for a certain duration. However, this would employ an external vessel like a ladle or the like and would likely usually be initiated in a manual mode.

In addition, the pump can simultaneously carry out modes, transfer, and/or scrap charge, and/or circulation of molten metal, wherein the discharge is carried out: at equal transfer and circulation flow rates; at a higher transfer flow rate and lower circulation flow rate; or at a lower transfer flow rate and higher circulation flow rate. This can occur as a result of the impeller straddling at least two of the impeller chambers at once. Those of ordinary skill in the art will appreciate in view of this disclosure that the impeller positioning apparatus enables a wide variety of possible flow rates and different modes of functionality within the scope of the present disclosure. Many other positions of the impeller are possible in accordance with the present disclosure.

A third aspect of the disclosure features a method of system installation comprising positioning a refractory base of a pump for pumping molten metal in a first well of a furnace. A refractory scrap charging vessel is positioned in a second well of the furnace. A refractory separating wall is located between the first well and the second well. A conduit is positioned over the separating wall between the pump and the scrap charging vessel.

A specific feature applicable to this third aspect includes forming the passageway in the refractory hearth wall between the second well and the hearth. Another specific feature is that the second conduit can be fastened between the outlet of the scrap charging vessel and the hearth to flow molten metal through the passageway in the hearth wall.

Another specific feature includes the scrap charging vessel being constructed and arranged to enable molten metal to travel from the first well, through the lower opening in the separating wall, into the second well and past the scrap charging vessel. For example, the scrap charging vessel may be disposed above a lower archway in the separating wall. As another example, the scrap charging vessel may include a lower through-passageway through which molten metal from the first well and out the archway of the separating wall can flow into the second well without being subject to the flowing inside the scrap charging vessel.

Many variations to the present disclosure are possible, which fall within its spirit and scope. For example, the impeller may include only an upper inlet opening with the lower end portion being an imperforate circular end face (upper intake), or only a lower inlet opening with the upper end portion being an imperforate circular end face (lower intake). One such suitable impeller is a PENTELLER® brand impeller with imperforate base, a squirrel-cage type impeller, barrel type impeller, or the like. The base may be configured so that the only inlet opening is located at the lower portion of the base, in the upper portion of the base, or so as to include upper and lower base inlet openings. A single intake impeller can be used, having an impeller inlet near only one end portion and impeller outlets near a side of the impeller. In another variation of impeller, a dual intake impeller having the ability to draw molten metal from the top and bottom base inlet openings may be used. The dual intake impeller (top and bottom feed impeller) can have inlet openings in upper and lower faces and outlet openings on a side of the impeller. The outlets of the impeller may be formed by passages or vanes.

An upper impeller having only a top intake and a separate lower impeller having only a bottom intake could also be mounted to the same shaft. A dual-intake impeller such as a baffle impeller having a baffle that prevents fluid communication between upper and lower passages in the impeller may be used in a pump base having upper and lower inlet openings. A suitable baffle impeller is disclosed in the CORIOLIS® vessel patent. Other variations include the number and location of base inlets and outlets, number of impeller chambers, number, material composition, position, size or type of discharge passages, risers and transfer conduit and the number, type and location of impellers or impeller members that are employed. The impeller outlet openings can traverse various heights and extents of the circumference of the impeller and can have various shapes and sizes. The three chamber pump may use a dual intake impeller.

In all aspects of this disclosure, although mention is made of a riser (e.g., a generally vertical conduit constructed of graphite) and a conduit connected to the riser (e.g., a generally horizontal conduit constructed of steel), the present disclosure contemplates within its scope combining these components or forming them of the same or different materials, including other materials like ceramics or composites. For example, a single refractory conduit (flexible or not) may extend from the pump base to the remote location, omitting the steel conduit and/or the graphite riser.

Use of the CHAMELEON® multifunctional pump by High Temperature Systems Inc. advantageously avoids the greater oxidation that occurs using the device of the U.S. Pat. No. 6,217,823 patent when all of the molten metal of the furnace is passed through the vortex vessel. In such a prior art device because the scrap charging device is always operated, a greater amount of gas is introduced into the molten metal, undesirably leading to more dross being formed in the bath and lower quality metal products. As a result, the molten metal of the present disclosure is expected to be more homogeneous, cleaner and able to produce metal articles more economically and with fewer defects.

The pump may include an apparatus for flowing gas down a shaft sleeve and out a bottom of the shaft sleeve, near an inlet opening of the base, inside one or more of the impeller chambers, or near a discharge passageway, as is known in the art. Suitable gases or additives include inert gases (e.g., argon or nitrogen) and reactive gases (e.g., chlorine containing gas). One suitable such system is the POSEIDON® pump by High Temperature Systems, Inc. Degassing can be carried out through the addition of inert gas to aluminum to remove hydrogen gas. The gas could be used to treat the molten metal or to purge one or more of the impeller chambers for periodic cleaning or enhanced operation. Flux particles may flow into the base, such as into its outlet opening, or near the base, such as down the shaft sleeve, and could be in liquid or particulate form, with or without accompanying gas flow.

The design of the system according to the disclosure enables its widespread adoption into existing furnaces of various construction. Previous designs suffered from various drawbacks. For example, many metal processing facilities (e.g., foundries) employ furnaces that do not even circulate molten metal or do not transfer molten metal. Many furnaces currently in use were designed and built a long time ago. The walls that compose the furnace are often comprised of a large amount of refractory brick. Furnaces often employ a separating wall between a first well and a second well. Operators of the metal processing facilities do not want to incur high costs modifying their furnaces.

The present system advantageously enables the separating wall to remain in place. In one specific example feature, the scrap charging vessel can feed into the hearth. Thus, the present system can be put in place in a wide variety of existing furnaces with minimal modification to the furnace. It can provide circulation, scrap charging and transfer of molten metal, with or without gas treatment and with or without flux treatment, which offers a tremendous versatility, simplicity and improved quality of molten metal processing. Molten metal from the furnace can be formed into metal articles, for example in a die casting operation.

Many additional features, advantages and a fuller understanding of the disclosure will be had from the accompanying drawings and the detailed description that follows. It should be understood that the above Disclosure of the Invention describes the disclosed subject matter in broad terms while the following Detailed Description describes the disclosed subject matter more narrowly and presents embodiments that should not be construed as necessary limitations of the broad invention as defined in the claims.

DETAILED DESCRIPTION

Figure 1:
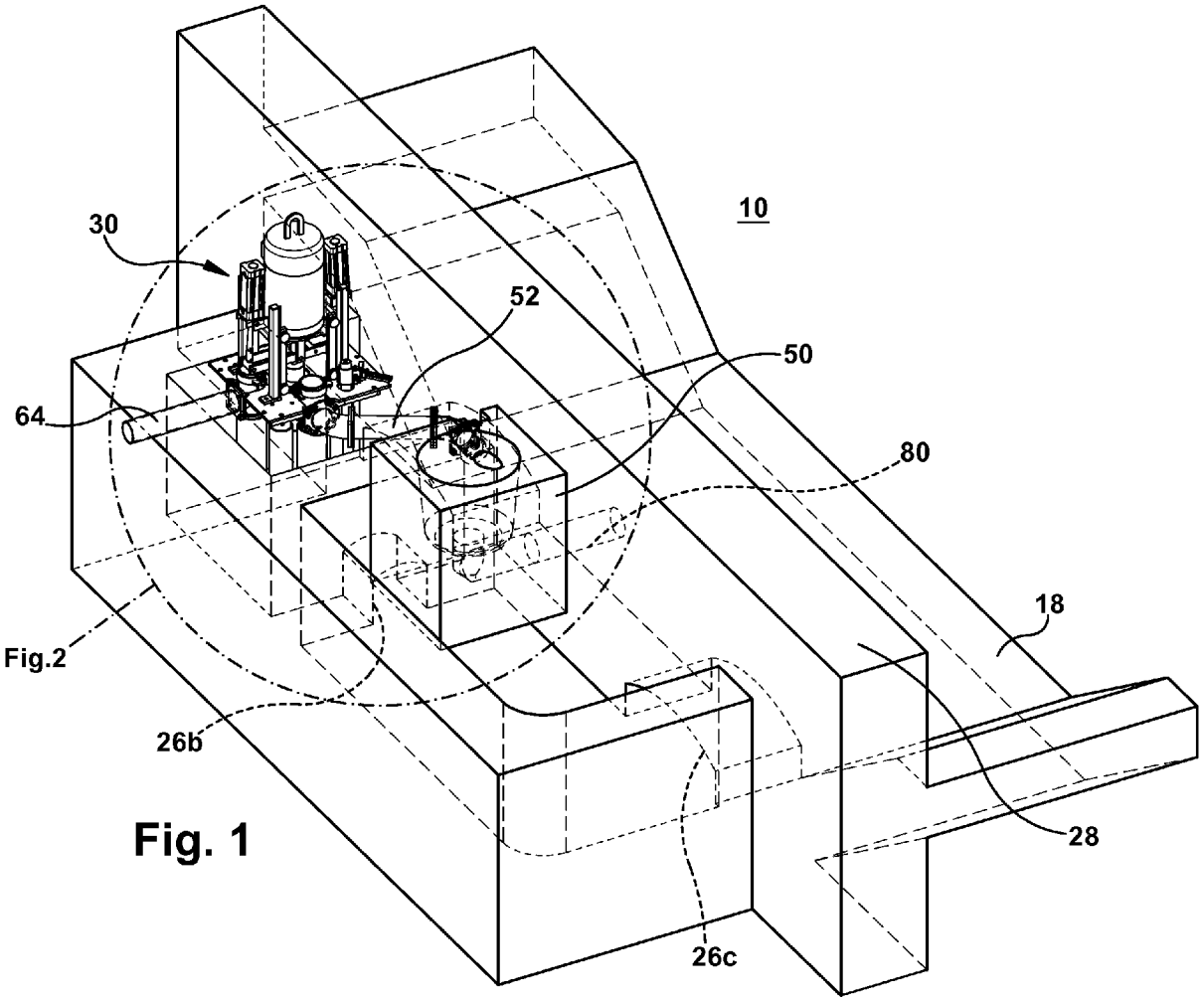
FIG. 1 is a perspective view of a furnace employing the system of the present disclosure including pump and scrap charging vessel.
Figure 2:
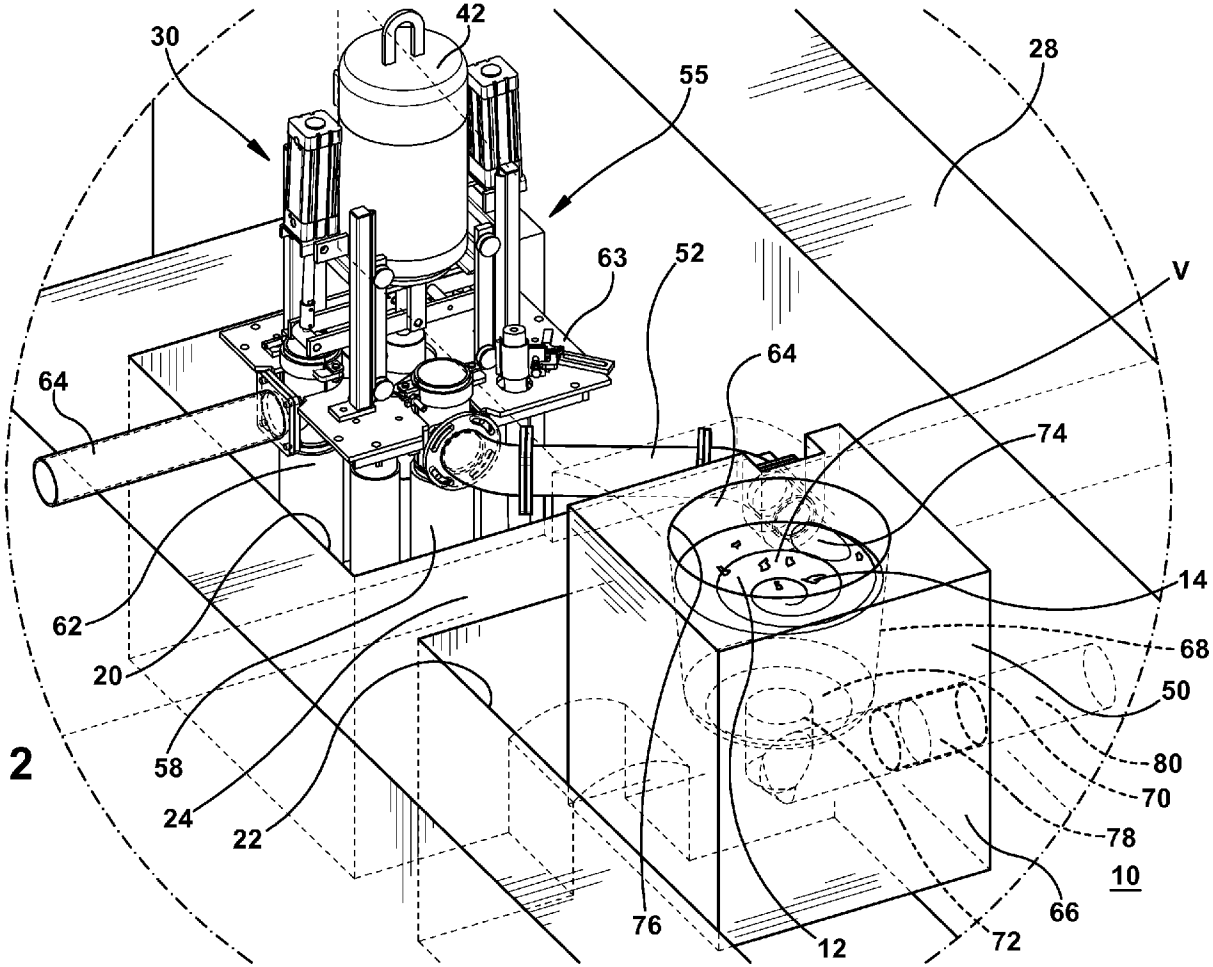
FIG. 2 is an enlarged perspective view showing the pump and scrap charging vessel of the present system.
Figure 3:
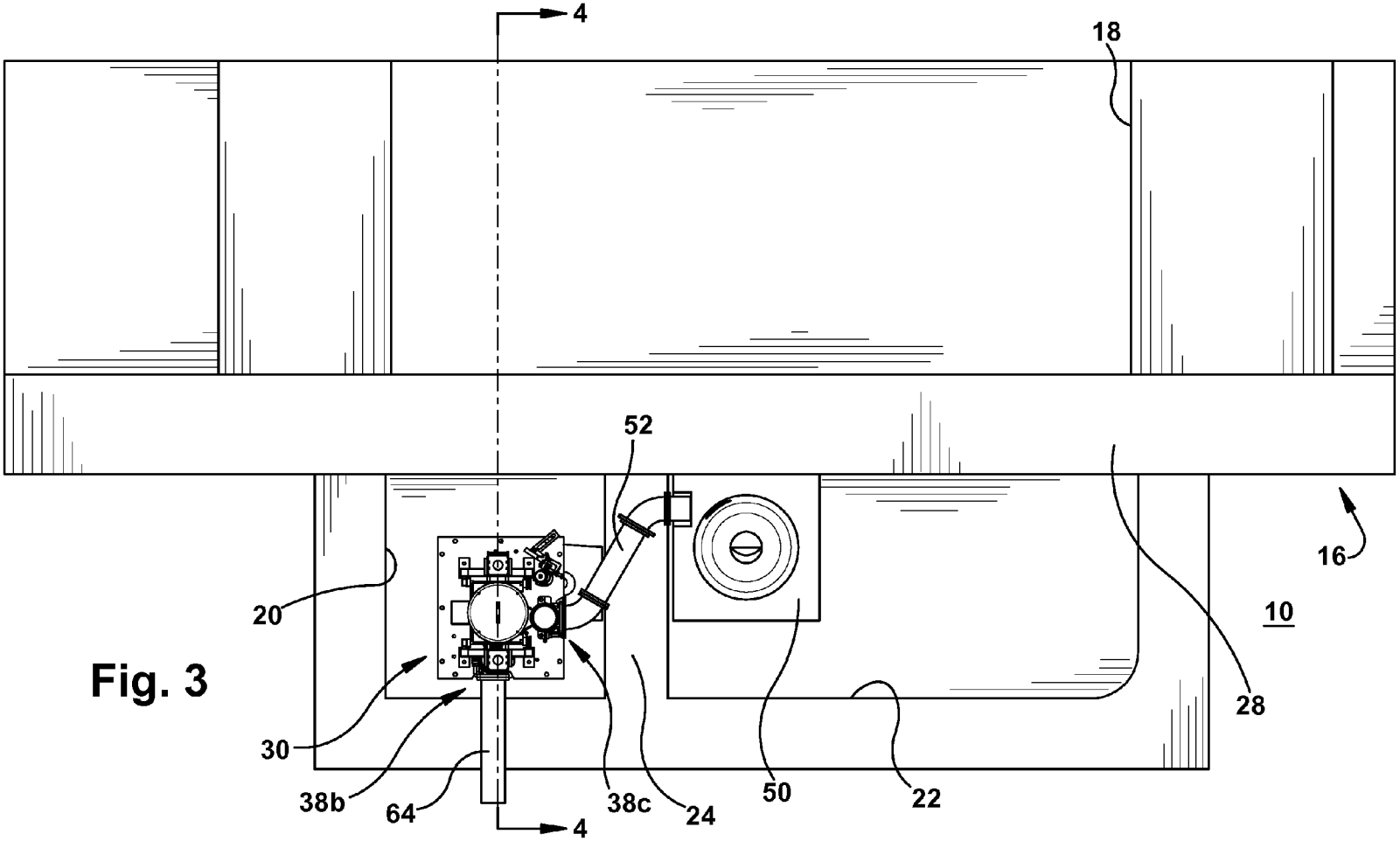
FIG. 3 is a top plan view of the furnace and present system.
Figure 6:
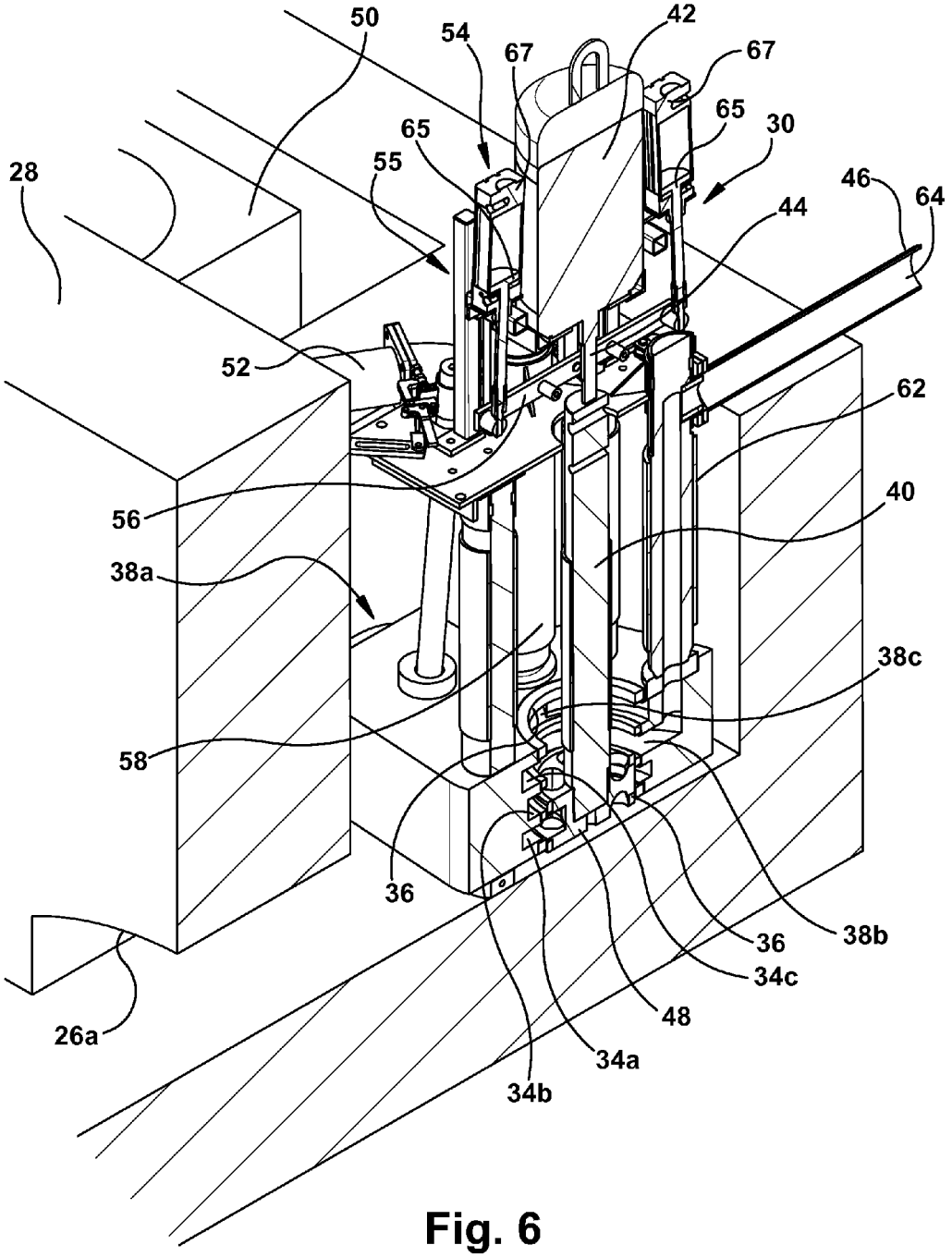
FIG. 6 is an enlarged perspective cross sectional view of the pump of this disclosure.

A system 10 of this disclosure is used to pump molten metal 12 and melt metal scrap 14 in a furnace 16. The furnace 16 is composed of refractory brick or block (referred to generally as refractory brick in this disclosure). Optional burners or other optional heating means (not shown) as known in the art are disposed in a main vessel 18 (e.g., a hearth). Ingots of metal can be melted in the hearth 18 or metal can be otherwise charged into the hearth. Outside the hearth 18 the furnace includes a first well 20 that is separated from a second well 22 by a refractory brick separating wall 24. The first well 20 and the second well 22 are in fluid communication with the hearth 18, though lower archways 26*a*, 26*c* in the walls between hearth and each well and lower archway 26*b* in the separating wall 24 between the first and second wells. These lower archways are below the molten metal level. In particular, in one example, the floor of the furnace forms a lower portion of the archway. The archways are passages for molten metal through a refractory brick wall. The first well and the second well are separated from the hearth by a refractory brick hearth wall 28. A pump 30 is disposed in the first well 20 and pumps molten metal to circulate molten metal from and into the hearth 18. The pump 30 includes a submerged base 32 including an impeller chamber 34 (e.g., lower impeller chamber 34*a*, middle impeller chamber 34*b*, and upper impeller chamber 34*c*), at least one base inlet opening 36 in fluid communication with the impeller chambers (upper and lower inlets 36 being shown), and a base outlet opening 38 (e.g., bottom circulation outlet opening 38*a*, middle transfer outlet opening 38*b*, and upper scrap discharge outlet opening 38*c*) extending from respective impeller chambers 34*a*, 34*b*, 34*c* (FIGS. 3 and 6). Also included is a pump shaft 40, a motor 42 having a drive shaft 44 connected to the pump shaft 40 via a coupling 46, and an impeller 48 fastened to a lower end portion of the pump shaft 40 and adapted to be rotated in the impeller chambers 34*a*, 34*b*, 34*c* when moved into position vertically. A scrap charging vessel 50 is disposed in the second well 22 into which the scrap 14 is added to molten metal 12 contained in the scrap charging vessel (FIG. 2). A conduit 52 is in fluid communication with the pump 30 and extends over the separating wall 24. Molten metal moved out of the pump 30 travels up a riser 58 to the conduit 52 and from the conduit 52 into the scrap charging vessel 50. For the sake of increasing clarity of the drawings, molten metal is not shown in FIGS. 1, 3 and 5-7 and is not shown in the baths of the first and second wells or in the hearth in FIG. 2, but would be present during operation of the apparatus.

Figure 4:
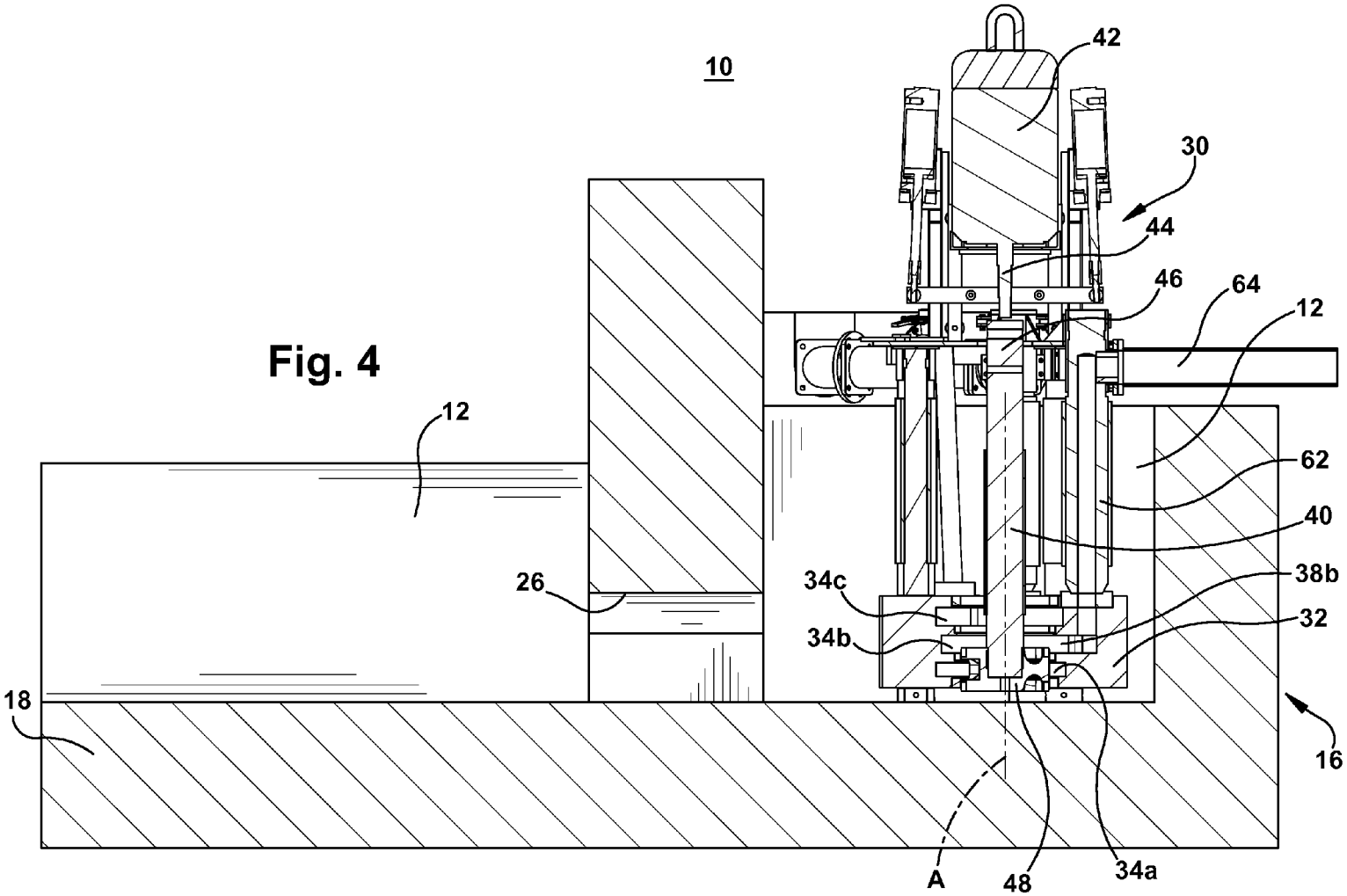
FIG. 4 is a vertical cross-sectional view taken along lines 4-4 in FIG. 3.
Figure 5:
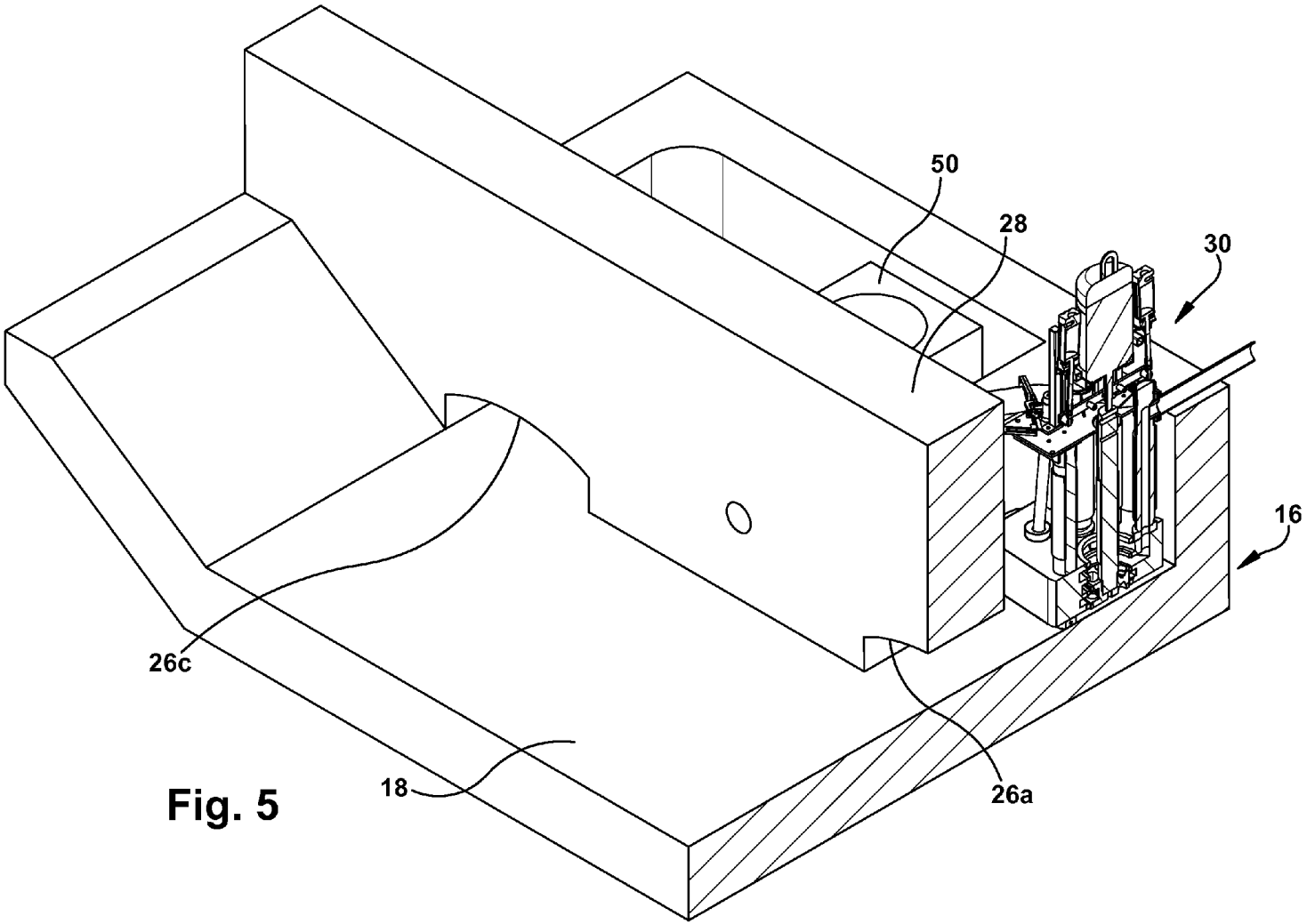
FIG. 5 is a perspective cross-sectional view of the present system.

A CHAMELEON® multifunctional pump by High Temperature Systems Inc. is particularly suitable (e.g., as described in the CHAMELEON® pump patents), as would be apparent to one skilled in the art in view of this disclosure. However, other pumps may be used such as a BULLDOG® pump made by High Temperature Systems Inc, as would be apparent to one skilled in the art in view of this disclosure The base 32 of the pump 30 can include at least one, at least two, or at least three, impeller chambers. In an example design shown in the drawings, the base includes the three impeller chambers 34*a*, 34*b*, 34*c*. These impeller chambers can be vertically stacked on each other so as to have a vertical axis A in common (FIG. 4). The impeller rotates about the axis A. The inlet openings 36 are in fluid communication with all of the impeller chambers 34*a*, 34*b*, 34*c* (albeit not all chambers are in immediate proximity to an inlet, as shown in the drawings). However, there could be multiple inlet openings in the base each leading directly and in proximity to an impeller chamber. An outlet opening 38*a*, 38*b*, 38*c* extends from impeller chambers 34*a*, 34*b*, 34*c*, respectively.

The base 32 is adapted to be submerged in molten metal and includes the first, second and third impeller chambers stacked on each other. The impeller chambers 34*a*, 34*b* and 34*c* may be termed "first", "second" or "third" impeller chambers in any order. It also should be appreciated that the pump could be designed so that the impeller chambers and their respective outlets are in different positions in the base than as shown and described. For example, the middle impeller chamber 34*b* could be the scrap charge impeller chamber rather than the transfer impeller chamber shown in FIG. 6. The impeller is connected to a lower end portion of a pump shaft 40. The motor 42 is supported above the molten metal on a motor mount plate. The motor mount plate 63 can have various configurations and in this particular design includes a plate having an opening for accommodating the shaft and may include openings for accommodating two risers and a flux or gas discharge pipe. The motor mount plate optionally supports brackets mounted to an optional upper adapter plate. Suitable motor mount plates, brackets and adaptor plates would be apparent to one skilled in the art in view of the CORIOLIS® vessel and CHAMELEON® pump patents in view of this disclosure. A variation of this design is shown in the drawings as discussed below, which moves the motor vertically for moving the impeller vertically, and does not mount the motor on an adaptor plate like in previous designs. The upper end portion of the shaft 40 is coupled by coupling 46 known in the art to the drive shaft of the motor, which rotates the impeller in a desired impeller chamber.

The base includes upper and lower circular inlet openings 36 that are concentric to each other around the axis of rotation A of the impeller and shaft. The base includes the three outlet passageways 38*a*, 38*b*, 38*c* enabling molten metal to leave the base. The bottom, outlet passageway 38*a* is a discharge passageway that extends from the bottom impeller chamber 34*a* to an exterior surface of the base. The middle outlet opening 38*b* extends from the middle impeller chamber 34*b* to a socket. A lower end of a riser 62 is cemented in the socket and the upper end of the riser extends near an upper surface of an outer side wall of the first well. The upper end of the riser 62 is fastened to a conduit 64 that extends to a remote location (e.g., for filling a ladle or launder). The upper outlet opening 38*c* extends from the upper impeller chamber 34*c* to a socket. A lower end of riser 58 is cemented in the socket and the upper end of the riser extends near an upper surface of the separating wall 24 (FIG. 2). The upper end of the riser 58 is mounted to the motor mount plate 63, and is fastened to the conduit 52 that extends to the scrap charging vessel 50.

The impeller chambers 34*a*, 34*b*, 34*c* have walls that form volutes in this example design. The volutes enable the pump to pump molten metal more efficiently compared to pumps in which the impeller is located in a nonvolute impeller chamber. On the other hand, the impeller chambers might also be formed without a volute such as to reduce a chance of jamming of the impeller.

The base, bearing rings, shaft, optional shaft sleeve and impeller of this disclosure are known to those of ordinary skill in the art and used in the CHAMELEON® multifunctional pump and other pumps for pumping molten metal, for example, as described in the CHAMELEON® pump patents. The parts that contact molten metal are formed of graphite except the bearing rings which may be composed of silicon carbide or other suitable wear-resistant refractory material. The graphite parts may be treated to enhance their lifetime. An optional shaft sleeve (not shown) may be used between the motor mount 63 and the base 32 including openings or a gap for at least one of molten metal inlet, gas outlet and flux outlet as used in the POSEIDON® pumps as described in the POSEIDON® pump patents.

Any suitable impeller may be used in this embodiment of the present invention including the squirrel cage impeller shown in the figures, vaned type and barrel type, single or dual intake, and baffle or not between impeller members. Examples of impellers that are suitable for use in the present invention are disclosed in U.S. Pat. No. 6,881,030, which is incorporated herein by reference in its entirety.

The impeller is advantageously able to be vertically moved up or down to one of the selected impeller chambers. This can maximize the flow of molten metal from the impeller chamber in which the impeller is rotated and can minimize or avoid entirely, molten metal flow from the other impeller chamber in which the impeller is not rotated. In transfer mode, the motor, its drive shaft and the pump shaft are moved vertically along the rotational axis to position the impeller in the selected transfer impeller chamber (e.g., impeller chamber 34*b*). This causes molten metal to be directed through the base inlet opening, into an inlet opening of the impeller, into the transfer impeller chamber 34*b* and out the outlet openings of the impeller, through the transfer discharge passageway 38*b* to the socket, and along the passageway in the riser 62 and conduit 64 to a desired discharge location. The system is advantageously suitable for use in die casting. When the pump is operated in the transfer mode, molten metal can be transferred to a ladle when desired. To perform this function, the impeller is moved into the transfer impeller chamber 34*b* and rotated there (FIG. 4 once the impeller is moved up to the middle transfer impeller chamber). The metal enters the ladle, for example, and is taken to a die casting machine as known in the art.

Referring to FIG. 6, an impeller positioning device 54 is adapted to move the impeller 48 in the base effective to place the impeller in one of the impeller chambers. The design of the impeller positioning device can be as described in the CHAMELEON® pump patents. However, the example impeller positioning device shown in the drawings enables the entire motor 42 to be moved up and down, rather than fixing the motor and moving only the shaft and impeller. The impeller 48 is connected to the motor 42 via the coupled pump and drive shafts 40, 44. So, moving the motor vertically moves the impeller as well. Suitable carriage structure 55 (FIG. 6) is used to enable the motor to move in response to piston 65 movement in the cylinders 67, so that the pump shaft moves along its rotational axis A. A device that employs hydraulic or pneumatic cylinders, carriage structure and associated equipment that is suitable for moving the motor, pump shafts and impeller according to this disclosure is used in the TRIDENT™ Series Rotary Flux Injection apparatus of High Temperature Systems Inc, which is incorporated herein by reference in its entirety.

Figure 7:
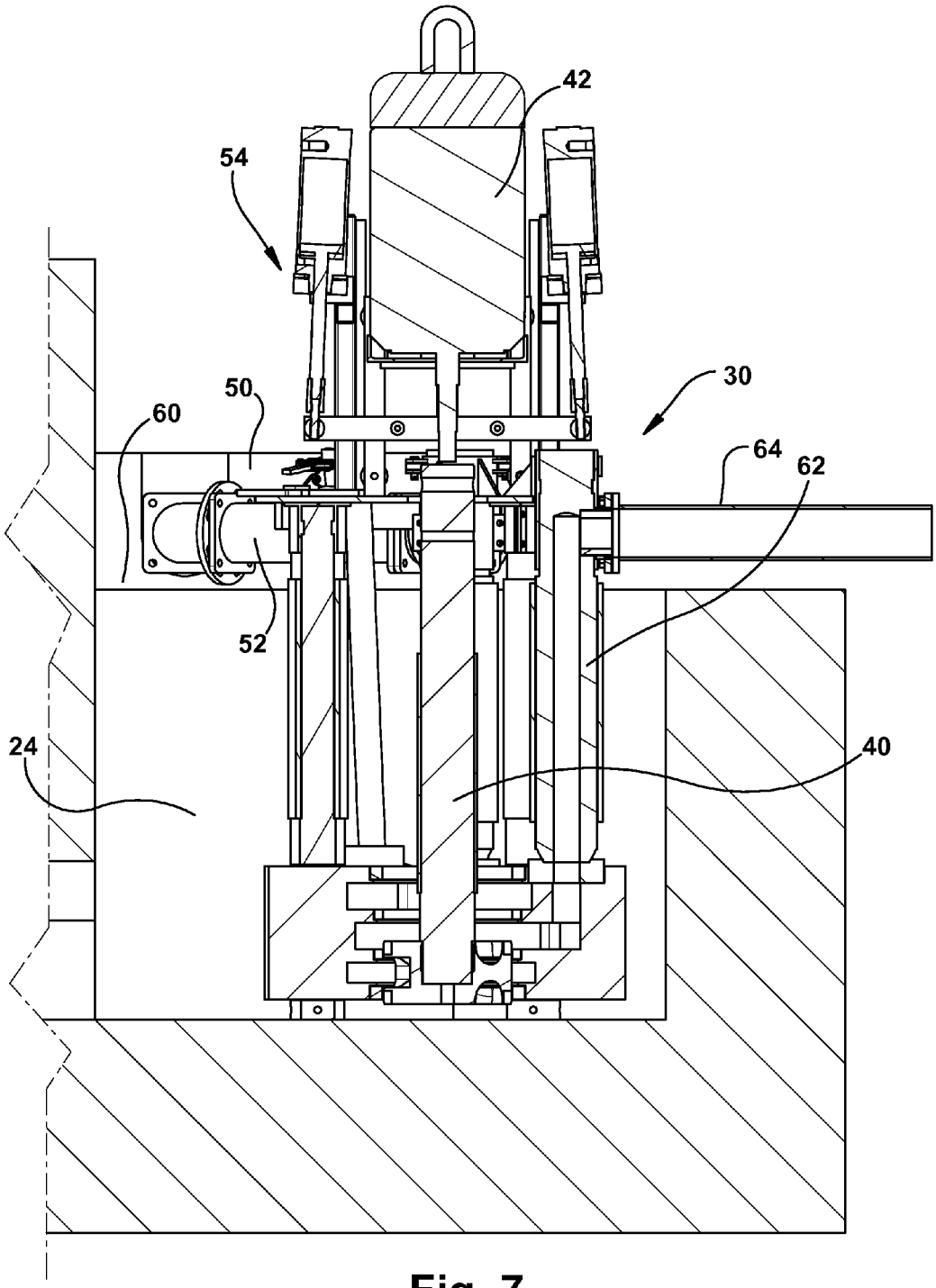
FIG. 7 is an enlarged, vertical cross-sectional view of the pump of this disclosure.

Referring to FIGS. 6 and 7, when both cylinders 67 are deactivated, the pistons are at the lowest strokes in both cylinders and the impeller 48 is at its lowest position in the lowest impeller chamber 34*a*. When one piston 65 moves to its up stroke, the member 56 pivots at an angle from the horizontal position shown in FIG. 6 and the motor 42 moves upward, enabling the impeller to be situated in the middle impeller chamber 34*b*. Finally, when the other cylinder 67 is also activated and the other piston 65 moves to its up stroke in its cylinder 67, the member 48 pivots again back to a horizontal position, the motor 42 moves upward again, and the impeller moves into the upper impeller chamber 34*c*.

When the impeller is placed in a first one of the impeller chambers, for example, chamber 34*a* (circulation mode) it releases molten metal into the base outlet opening 38*a* as known from the CHAMELEON® pump patents. The molten metal travels from the hearth, into the first well, through the pump, through the archway of the separating wall and into the second well. The base outlet opening 38*a* is a passageway that leads to an exterior of the base so as to discharge the pumped molten metal from the first well through the passage in the separating wall 24 into the second well. In circulation mode, the motor, its drive shaft and the pump shaft have been moved vertically along the rotational axis to position the impeller in the circulation impeller chamber 38*a*. This causes molten metal to be directed through the base inlet openings, into the circulation impeller chamber, out the impeller outlet openings, through the circulation discharge passageway 38*a* and through the archway between the first and second wells. When the impeller is rotated in the circulation impeller chamber, the multifunctional pump will circulate molten metal. This provides advantages including a more homogeneous, lower temperature bath and reduced fuel requirements for the burners of the hearth. This mode of circulation of molten metal in the furnace may be the predominant operation. The circulation mode may be used at times when scrap charging and transfer operations are not carried out. On the other hand, it will be apparent to one skilled in the art in view of this disclosure that operations may be carried out simultaneously, the operations being selected from the group consisting of circulation, transfer, scrap charging, and combinations thereof. This can be conducted by the impeller straddling impeller chambers, for example as described in the CORIOLIS® vessel patents or CHAMELEON® pump patents.

When the impeller positioning device places the impeller in the upper impeller chamber 34*c* (scrap charging mode), the molten metal travels through the upper outlet opening 38*c* to the riser 58. The riser 58 extends to near an upper surface 60 of the separating wall (FIG. 7), and could extend to a location below the separating wall surface, at the same level as the surface or above the surface. The conduit 52 extends from the riser over the separating wall to a location above the scrap charging vessel 50 (not shown) or into a side of the scrap charging vessel (FIGS. 2 and 7). As a result of rotation of the impeller in the impeller chamber of the base, molten metal is drawn into the (e.g., second) in this case upper, impeller chamber 34*c*, travels up the riser 58, through the conduit 52 and into the scrap charging vessel 50. In an example design, the conduit between the pump and scrap charging vessel extends to the exterior surface of the scrap charging vessel so that molten metal enters the scrap charging vessel tangentially from a top view in a manner of the CORIOLIS® scrap charging vessel available from High Temperature Systems.

The base 50 can include a (e.g., third) impeller chamber, for example, middle (transfer) impeller chamber 34*b*. The base inlet openings 36 are in fluid communication with the third impeller chamber 34*b*. The (e.g., third) in this case, middle base outlet opening 38*b* extends from the third impeller chamber. The riser 62 extends from the (e.g., third) in this case middle outlet opening 38*b* to a location outside of the first well. When the impeller positioning device places the impeller in the impeller chamber 34*b*, the molten metal travels through the outlet opening 38*b* into the second riser 62. The conduit 64 extends from the riser 62, moving the molten metal to a remote location over a ladle, for example, or other transfer device, that is put into position to receive molten metal transferred from the pump. This conduit 64 may extend to a die casting machine or to a ladle taken to a die casting machine, for casting metal parts or components.

More specifically, the scrap charging vessel 50 is used to melt scrap metal in the molten metal (e.g., aluminum can scrap in molten aluminum). Molten metal contained in the hearth is caused to circulate by the pump when the impeller rotates in the circulation impeller chamber. In one furnace design, molten metal is drawn from the hearth 18 by the pump and caused to circulate from the first (e.g., pump) well 20 to the second (e.g., scrap charging) well 22, and back to the hearth 18. In this regard, the scrap charging vessel may be disposed above the archway 26*b* in the separating wall (see FIGS. 1 and 2) so that molten metal travels beneath the scrap charging vessel. On the other hand, the scrap charging vessel 50 may be disposed on the furnace floor and may include a circulation though-passageway for molten metal from the archway between wells (not shown but as described in the CORIOLIS® vessel patents) to travel through the scrap charging vessel. This circulating molten metal would not normally be directly involved in scrap charging. An additional optional well or wells may also be used in the furnace (e.g., a dross well) depending on its design.

Scrap metal 14 is added to molten metal 12 in the scrap charging vessel positioned in the second well 22. It is desired to facilitate rapid melting of the scrap, but this is difficult to achieve because the scrap has a low density causing it to float.

The scrap charging vessel 50 facilitates submergence and melting of metal scrap in molten metal. The scrap charging vessel is formed from a block of refractory material. Referring to FIG. 2, the scrap charging vessel includes an interior surface 64 that contains molten metal 12 in the vessel and an exterior surface 66 that contact molten metal in the second well 22 into which the vessel is partially submerged. The scrap charging vessel 50 protrudes from above the molten metal surface so that a portion of its interior and exterior surfaces are above the molten metal line and are not in continuous contact with the molten metal (FIG. 2). The interior surface 64 includes a side wall 68 and a bottom surface 70 (FIG. 2). An outlet passageway 72 is located near a lower portion of the vessel extending from the bottom surface 70 of the vessel. An inlet passageway 74 optionally extends through the side wall of the vessel and above the outlet passageway 72. The conduit 52 is fastened to the vessel in fluid communication with the inlet passageway 74. The upper portion of the interior surface forms a mouth 76 configured to receive the metal scrap 14. Molten metal 12 optionally enters the vessel from the inlet passageway at a location offset from a central axis of the vessel and, in particular, at a location tangential to the interior surface of the vessel as disclosed in the CORIOLIS® vessel patent. On the other hand, when no inlet passageway is used through the side wall of the vessel block, the molten metal may be directed so as to flow from above, down through the mouth. The scrap charging vessel wall may have a circular, oval or other shape, for example, as seen from a top view, and the interior surface may be flat, bowl-shaped or conical as seen in a vertical cross-sectional view, for example. The interior surface may have a combination of shapes and configurations (e.g., grooves, and/or different sloped or curvature surfaces). The scrap charging vessel 50 is cylindrical in this exemplary design as seen from a top view. Molten metal 12 leaves the scrap charging vessel 50 through the outlet passageway 72. The outlet passageway 72 extends downwardly from the interior bottom surface 70 of the vessel to its exterior surface 66.

Molten metal is drawn into the base of the pump by rotation of the impeller in one of the impeller chambers (if more than one is used), leaves the base 32 and travels through the riser 58 and the conduit 52. Molten metal travels from the conduit 52 and through the vessel inlet passageway 74 into the scrap charging vessel 50. Molten metal 12 enters the scrap charging vessel from the inlet passageway 74, in particular, at a location substantially tangential to the interior surface of the vessel (as illustrated from a top view). The molten metal in the scrap charging vessel flows in a vortex V. The vortex flow of molten metal effectively pulls the metal scrap 14 introduced in the mouth of the scrap charging vessel down into the molten metal along the vortex flow path V. The molten metal travels 12 downwardly along the side wall 68 through the outlet passageway 72 of the vessel. The molten metal then travels from the scrap charging vessel, through an optional second conduit 78 (FIG. 2), through a passageway 80 in the hearth wall and directly into molten metal 12 contained in the hearth 18 (rather than from the scrap charging vessel into the second well and then through an archway into the hearth). The location of entry into the hearth may be above the molten metal line inside the hearth. Alternatively, the molten metal may travel out of the outlet passageway 72 of the scrap charging vessel and into the second well, rather than into the hearth (not shown), if backflow of the molten metal into the first well is not a concern. In that case, the outlet passageway 72 could be rotated 90 degrees from and be perpendicular to the direction shown in FIG. 2. It could extend to an exterior surface of the scrap charging vessel that is perpendicular to the hearth wall.

The impeller positioning device 54 may employ an "infinite control" mechanism, such as a servo-pneumatic type actuator and control. One example of such an actuator is referred to as a Bimba™ Position Feedback Cylinder, Model PFC-506-BFP, described in the brochure "Bimba Position Feedback Cylinders," pp. 7.5-6, which is incorporated herein by reference in its entirety. One example of such a control is Bimba™ Pneumatic ControlSystem Model PCS, ModelPCS-5-Q, which is described in the brochure "Bimba Position Control System" pp. 7.25, 7.26, 7.30, which is incorporated herein by reference in its entirety.

Another suitable "infinite control" mechanism is a servo-electronic screw drive type actuator and control. One example of such an actuator is referred to as Electrak 205 by Thomson™, Model Nos. ALP12-0585-08D or ALP22-0585-08D. One example of such a control by Thomson™ has Model Nos. MCS-2051 or MCS-2052. These actuators and controls are described in the Elektrak 205 brochure by Thomson, pp. D-26, D-27, D-53 and D-54, which is incorporated herein by reference in its entirety. Position feedback cylinders suitable for infinite control of the impeller in the impeller chambers is described in Schneider, R., "Working with Position-Feedback Cylinder Technology," printed May 24, 2005 {http://www.bimba.com/techctr/schneidr/htm), reprinted from Hydraulics & Pneumatics, September 1996, which is incorporated herein by reference in its entirety.

Both the servo-pneumatic type actuator and control system and the servo-electronic screw drive type actuator and control system could include a PLC, enabling the pump operator to program the desired impeller position depending on process parameters.

The pump and/or scrap charging vessel are easily removable from the pump well for cleaning and repair. Due to the extremely harsh environment of a molten metal bath, pump shafts, impellers and other parts deteriorate rapidly and require periodic replacement. Rather than constructing an upper conduit and/or passageway that extends through the separating wall to the scrap charging vessel, and rather than the labor intensive removal of the separating wall, the pump and scrap charging vessel are installed to function over the separating wall, making construction, operation and maintenance of the system more economical and efficient. It should be appreciated that the present system of the disclosure may include suitable support brackets and fasteners (not shown) for removably anchoring the pump and scrap charging vessel in a fixed position in the furnace. All components of the scrap charging vessel that are subjected to the molten metal environment are constructed of refractory material, for example, graphite or ceramic. One suitable ceramic material is silicon carbide. Components outside the molten metal, for example, the motor mount plate, conduit, elbows and support brackets, may be formed of steel.

Many modifications and variations of the disclosed subject matter will be apparent to those of ordinary skill in the art in light of the foregoing disclosure. Therefore, it is to be understood that, within the scope of the appended claims, the invention can be practiced otherwise than has been specifically shown and described.

What is claimed is:

1. A system for pumping molten metal and melting metal scrap in a furnace including a first well that is separated from a second well by a refractory separating wall, the first well and the second well being in fluid communication with a main vessel containing a volume of molten metal greater than a combined volume of molten metal in the first well and the second well, the separating wall including a lower passageway for molten metal, the system comprising:

a pump disposed in the first well for pumping molten metal, wherein said pump comprises:

a base submerged in the molten metal including an impeller chamber;

a base inlet opening in fluid communication with said impeller chamber, a base outlet opening from said impeller chamber;

a refractory pump shaft;

a motor adapted to rotate said refractory pump shaft;

a refractory impeller fastened to said refractory pump shaft and adapted to be rotated in said impeller chamber;

a scrap charging vessel disposed in the second well, said scrap charging vessel being adapted to form a molten metal vortex that draws down the scrap that is added to molten metal contained therein; and a conduit in fluid communication with said pump and extending over said separating wall to a location near an upper portion of said scrap charging vessel, wherein molten metal pumped from said pump travels from said conduit into said scrap charging vessel.

2. The system of claim 1 wherein said scrap charging vessel includes an exterior surface, an interior surface forming a mouth at an upper end portion that can receive the scrap and an outlet, wherein the molten metal flows in a vortex along the interior surface to said outlet.

3. The system of claim 1 wherein the first well and the second well are separated from a hearth as said main vessel by a refractory hearth wall and said scrap charging vessel includes an outlet passageway adjacent and in fluid communication with a passageway in said refractory hearth wall.

4. The system of claim 3, comprising a second conduit that extends between said outlet passageway of said scrap charging vessel and said passageway in said refractory hearth wall.

5. The system of claim 3 wherein the interior surface of said scrap charging vessel includes a side surface and a bottom surface and said outlet passageway of said scrap charging vessel is disposed below said bottom surface.

6. A system for pumping molten metal and melting metal scrap in a furnace including a first well that is separated from a second well by a refractory separating wall, the first well and the second well being in fluid communication with a main vessel containing a volume of molten metal greater than a combined volume of molten metal in the first well and the second well, the separating wall including a lower passageway for molten metal, the system comprising:

a pump disposed in the first well for pumping molten metal, wherein said pump is a multifunctional pump comprising:

a base submerged in the molten metal including a first impeller chamber and a second impeller chamber vertically stacked relative to each other along the same axis, a base inlet opening in fluid communication with at least one of said first impeller chamber and said second impeller chamber, and a first base outlet opening from said first impeller chamber and a second base outlet opening from said second impeller chamber, said second base outlet opening being in fluid communication with said conduit;

a refractory pump shaft;

a motor adapted to rotate said shaft;

a refractory impeller fastened to said shaft and adapted to be rotated in said first impeller chamber and said second impeller chamber; and an impeller positioning device adapted to move said impeller in said base effective to place said impeller in said first impeller chamber so as release molten metal into said first base outlet opening and in said second impeller chamber so as to release molten metal into said second base outlet opening;

a scrap charging vessel disposed in the second well, said scrap charging vessel being adapted to form a molten metal vortex that draws down the scrap that is added to molten metal contained therein; and a conduit in fluid communication with said pump and extending over said separating wall to a location near an upper portion of said scrap charging vessel, wherein molten metal pumped from said pump travels from said conduit into said scrap charging vessel;

wherein said second base outlet opening is in fluid communication with said conduit.

7. The system of claim 6 comprising a riser extending between said second base outlet opening and said conduit.

8. The system of claim 6 wherein said first base outlet opening is a passageway that leads to an exterior of said base so as to discharge the molten metal from the first well through the passage in said separating wall into the second well.

9. The system of claim 6 wherein said base includes a third impeller chamber vertically stacked relative to said first impeller chamber and said second impeller chamber along the same axis, said base inlet opening is in fluid communication with at least one of said first impeller chamber, said second impeller chamber and said third impeller chamber, a third base outlet opening from said third impeller chamber, and a second riser extending from said third base outlet opening for transferring molten metal to a location outside of the first well.

10. The system of claim 7 wherein said riser extends to a location near a top of said separating wall.

11. A method of pumping molten metal and melting metal scrap using the system of claim 6 comprising:

rotating said impeller in said second impeller chamber so as to pump molten metal from the first well, through said conduit over the separating wall and into the scrap charging vessel;

charging scrap into said scrap charging vessel;

melting said scrap in said scrap charging vessel; and flowing molten metal out of said scrap charging vessel.

12. The method of claim 11 wherein the first well and the second well are separated from a hearth as said main vessel by a refractory hearth wall and said scrap charging vessel includes an outlet passageway in fluid communication with a passageway in said refractory hearth wall, comprising flowing molten metal out of said scrap charging vessel through said outlet passageway of said scrap charging vessel, through said passageway in said refractory hearth wall and into molten metal of said hearth.

13. The method of claim 11 comprising:

using said impeller positioning device to move said impeller into said first impeller chamber, wherein said first outlet opening is a discharge passageway to an exterior of said base; and rotating said impeller in said first impeller chamber so as to pump molten metal from the first well, through said discharge passageway, through the opening in the separating wall and into the second well.

14. The method of claim 11, wherein said base includes a third impeller chamber vertically stacked relative to said first impeller chamber and said second impeller chamber along the same axis, said base inlet opening is in fluid communication with at least one of said first impeller chamber, said second impeller chamber and said third impeller chamber, a third base outlet opening from said third impeller chamber, and a second riser extending from said third base outlet opening connected to a transfer conduit leading to a location outside of the first well, the method comprising:

using said impeller positioning device to move said impeller into said third impeller chamber;

rotating said impeller in said third impeller chamber so as to pump molten metal from the first well through said second riser and transferring the molten metal through said transfer conduit to a location outside of the first well.

15. A method of installing the system of claim 1 comprising positioning said pump for pumping molten metal in the first well of said furnace;

positioning said scrap charging vessel in said second well of said furnace;

positioning said conduit over said separating wall between said pump and said scrap charging vessel;

mounting said pump in a position of the furnace submerging said base in molten metal; and positioning said scrap charging vessel in molten metal of the furnace, wherein said conduit is positioned in fluid communication with said pump and so as to extend over said separating wall to a location near an upper portion of said scrap charging vessel.

16. The method of claim 15 wherein said scrap charging vessel is constructed and arranged to enable molten metal to travel from the first well, through the separating wall, into the second well and past said scrap charging vessel.

17. The method of claim 15 wherein the first well and the second well are separated from a hearth as said main vessel by a refractory hearth wall and said scrap charging vessel includes an outlet passageway, the method comprising:

forming a passageway in said refractory hearth wall between the second well and said hearth; and fastening a conduit between said outlet passageway of said scrap charging vessel and said passageway in said hearth wall.

* * * * *